United States Patent [19]

Newell

[11] Patent Number: 4,953,439

[45] Date of Patent: Sep. 4, 1990

[54] ELECTRONIC MUSICAL INSTRUMENT WITH QUANTIZED RESISTANCE STRINGS

[75] Inventor: Harold R. Newell, South Newbury, N.H.

[73] Assignee: Mesur-Matic Electronics Corp., Salem, Mass.

[21] Appl. No.: 66,584

[22] Filed: Jun. 26, 1987

[51] Int. Cl.[5] ..... G10H 1/18; G10H 5/00

[52] U.S. Cl. ..... 84/655; 84/682; 84/722; 84/DIG. 30

[58] Field of Search ..... 84/1.15, 1.16, DIG. 30, 84/655, 682, 722

[56] References Cited

U.S. PATENT DOCUMENTS

| | | | |
|---|---|---|---|
| 3,902,395 | 9/1975 | Avant | 84/1.16 |
| 4,038,897 | 8/1977 | Murray et al. | 84/1.16 |
| 4,300,431 | 12/1979 | DeRocco | 84/1.16 X |
| 4,372,187 | 2/1983 | Berg | 84/DIG. 30 X |
| 4,430,918 | 2/1984 | Meno . | |
| 4,621,557 | 11/1986 | Newell | 84/1.16 X |
| 4,630,520 | 12/1986 | Bonanno | 84/DIG. 30 X |
| 4,653,376 | 3/1987 | Allured et al. | 84/DIG. 30 X |
| 4,697,492 | 10/1987 | Freed | 84/1.16 |

FOREIGN PATENT DOCUMENTS 0032708 3/1978 Japan .

*Primary Examiner*—Stanley J. Witkowski

*Attorney, Agent, or Firm*—Pollock, Vande Sande & Priddy

[57] ABSTRACT

For reading the frets of a stringed electronic musical instrument, a plurality of resistance wire strings are secured to a nut end and a bridge of the instrument, with the strings superposing in parallel relationship over a plurality of conducting frets mounted on a fingerboard on the instrument. The voltages produced by depressing the strings to the conducting frets, after being inverted and linearized, are quantized to levels representative of the particular frets to obviate the effects of contact resistance, and decision voltage levels are selected so as to account for such contact resistance. To enable the signals to be fed as conventional information through a MIDI channel to a synthesizer for generating frequencies corresponding to the signals, an analog to digital converter is used. The different components, as well as the digitized linearized signals, are selectively controlled and fed, respectively, to a microprocessor.

12 Claims, 4 Drawing Sheets

| STRING | NOTE NUMBERS (STANDARD TUNING) | | | | | | | | | | | |
|---|---|---|---|---|---|---|---|---|---|---|---|---|
| 1 | E4 | 64 | 65 | 66 | 67 | 68 | 69 | 70 | 71 | 72 | 73 | 74 | 75 |
| 2 | B3 | 59 | 60 | 61 | 62 | 63 | 64 | 65 | 66 | 67 | 68 | 69 | 70 |
| 3 | G3 | 55 | 56 | 57 | 58 | 59 | 60 | 61 | 62 | 63 | 64 | 65 | 66 |
| 4 | D3 | 50 | 51 | 52 | 53 | 54 | 55 | 56 | 57 | 58 | 59 | 60 | 61 |
| 5 | A2 | 45 | 46 | 47 | 48 | 49 | 50 | 51 | 52 | 53 | 54 | 55 | 56 |
| 6 | E2 | 40 | 41 | 42 | 43 | 44 | 45 | 46 | 47 | 48 | 49 | 50 | 51 |

FIG. 4

| FRET # | | FRET VOLTS | LOG AMP OUTPUT V K=3.98634 | DIGITAL DATA | |
|---|---|---|---|---|---|
| | | | | A-D OUT 1BIT=.01v | +30% REF |
| NUT | 0 | 2.4000 | 0.0707 | 07H | 0AH |
| | 1 | 2.2653 | 0.1707 | 11H | 14H |
| | 2 | 2.1382 | 0.2707 | 1BH | 1EH |
| | 3 | 2.0182 | 0.3707 | 25H | 28H |
| | 4 | 1.9049 | 0.4707 | 2FH | 32H |
| | 5 | 1.7980 | 0.5707 | 39H | 3CH |
| | 6 | 1.6971 | 0.6707 | 43H | 46H |
| | 7 | 1.6018 | 0.7707 | 4DH | 50H |
| | 8 | 1.5119 | 0.8707 | 57H | 5AH |
| | 9 | 1.4270 | 0.9707 | 61H | 64H |
| | 10 | 1.3740 | 1.0707 | 6BH | 6EH |
| | 11 | 1.2714 | 1.1707 | 75H | 78H |
| 1st OCT | 12 | 1.2000 | 1.2707 | 7FH | 82H |
| | 13 | 1.1327 | 1.3707 | 89H | 8CH |
| | 14 | 1.0691 | 1.4707 | 93H | 96H |
| | 15 | 1.0091 | 1.5707 | 9DH | A0H |
| | 16 | .9524 | 1.6707 | A7H | AAH |
| | 17 | .8990 | 1.7707 | B1H | B4H |
| | 18 | .8485 | 1.8707 | BBH | BEH |
| | 19 | .8009 | 1.9707 | C5H | C8H |
| | 20 | .7560 | 2.0707 | CFH | D2H |
| | 21 | .7135 | 2.1707 | D9H | DCH |
| | 22 | .6735 | 2.2707 | E3H | E6H |
| | 23 | .6357 | 2.3707 | EDH | F0H |
| 2nd OCT | 24 | .6000 | 2.4707 | F7H | FAH |

ELECTRONIC MUSICAL INSTRUMENT WITH QUANTIZED RESISTANCE STRINGS

FIELD OF ART

The present invention relates to electronic musical instruments and more particularly to a stringed electronic musical instrument and a method for reading the frets thereof.

BACKGROUND OF THE INVENTION

To control a synthesizer from a stringed musical instrument such as a guitar, the frets of the guitar have to be detected. A conventional acoustic guitar has six strings, with each string vibrating at a frequency that is dependent on its length, its weight and its tension with respect to how it is secured to the guitar. The strings of the guitar are stretched out over what is known as a fingerboard (or fret board), with the latter having mounted or integrated thereon a plurality of spaced parallel frets. Thus, when a performer pushes his fingers down at a fret position, he in effect is tying that string against the fret, thereby shortening the string and therefore causing the string to vibrate at a higher frequency. The sound, or more precisely the pitch of the sound, obtained from each string is thereby controlled. In an electronic guitar, to determine the particular frequency of a string, which frequency is to be generated by a synthesizer in response to the signal generated from the string, the particular fret onto which the string is displaced in contact with needs to be read to determine the frequency the synthesizer is to generate.

Japanese Laid Open Patent Application No. 32708/78 discloses an electronic musical instrument which uses electrical resistance wires as strings to obtain changes of voltages or currents, in reference to the length of the resistance strings. In a specific embodiment, the Japanese reference teaches that a string may be pressed to a fret for completing an electrical circuit to generate an output voltage, which may then be amplified and converted into a frequency signal. Different frets may be contacted by the string to generate different signals. This Japanese reference, however, fails to take into consideration instances where the string may not be in direct contact with a fret or, due to unforeseen happenings—such as dirt or oxidation accumulating at the string—where the resistance of the string would be changed somewhat. This variation in frequency in turn would affect the accuracy of the frequencies generated.

It is, therefore, an objective of the present invention to provide for a method of reading the frets in a stringed electronic musical instrument so that frequencies which more accurately correspond to the frets in contact with the strings may be obtained.

It is another objective of the present invention to provide for a stringed electronic musical instrument that can be practiced with the above-mentioned advantageous method.

It is yet another objective of the present invention to provide at relatively low expense an electronic musical instrument that can generate frequencies reflecting accurately the frets on its fingerboard.

It is yet a further objective of the present invention to provide an electronic musical instrument using resistance strings which are arranged so as to obviate the undesirable effects of contact resistance.

SUMMARY OF THE INVENTION

To accomplish the aforesaid objectives, the stringed musical instrument of the present invention includes a fingerboard which has mounted thereon a plurality of conductive frets, each connected to ground. Interposed between and connected to a nut end and a bridge of the musical instrument are a number of resistance wire strings, superposing in spaced relationship over the conductive frets. A constant current source is applied to the strings so that when any one of the strings is displaced toward the fingerboard and in contact with any one of the frets, a complete electrical circuit is formed. And depending on the length of the depressed string, in relation to the fret (or the area on the fingerboard) the string is in contact with and the bridge, a voltage representative of the contacted fret is outputted to an analog multiplexer. To obviate the effect of foreign matter such as dirt and oxidation on the strings, which in the absence of the invention may produce false resistance values, the voltage, after inversion and linearization, is quantized to a level representative of the particular fret contacted. Since contact resistance tends to increase the resistance of the string, decision levels for quantizing are used such that detected voltage values up to a predetermined amount greater than what a particular fret voltage would be in the absence of contact resistance are quantized to the representative level for that fret.

In the specific apparatus utilized, voltages from the strings are inputted into an analog multiplexer and outputted therefrom to a log amplifier so that the voltage differences between adjacent frets are the same, thereby permitting the processor to easily determine which fret is being contacted by the string. To render the analog signals compatible with a conventional microprocessor, both for speed and simplicity, an analog to digital converter is used to convert the analog amplified signals from the log amplifier, before the same are fed to the microprocessor. Appropriate information representative of conventional musical note numbers is then fed through a conventional MIDI (Musical Instrument Digital Interface) channel to the synthesizer for generating the appropriate frequencies.

BRIEF DESCRIPTION OF THE DRAWINGS

FIG. 4 is a chart showing the exemplary fret numbers, fret voltages and voltages outputted from the system of FIG. 2.

DETAILED DESCRIPTION OF THE PRESENT INVENTION

Figure 1:
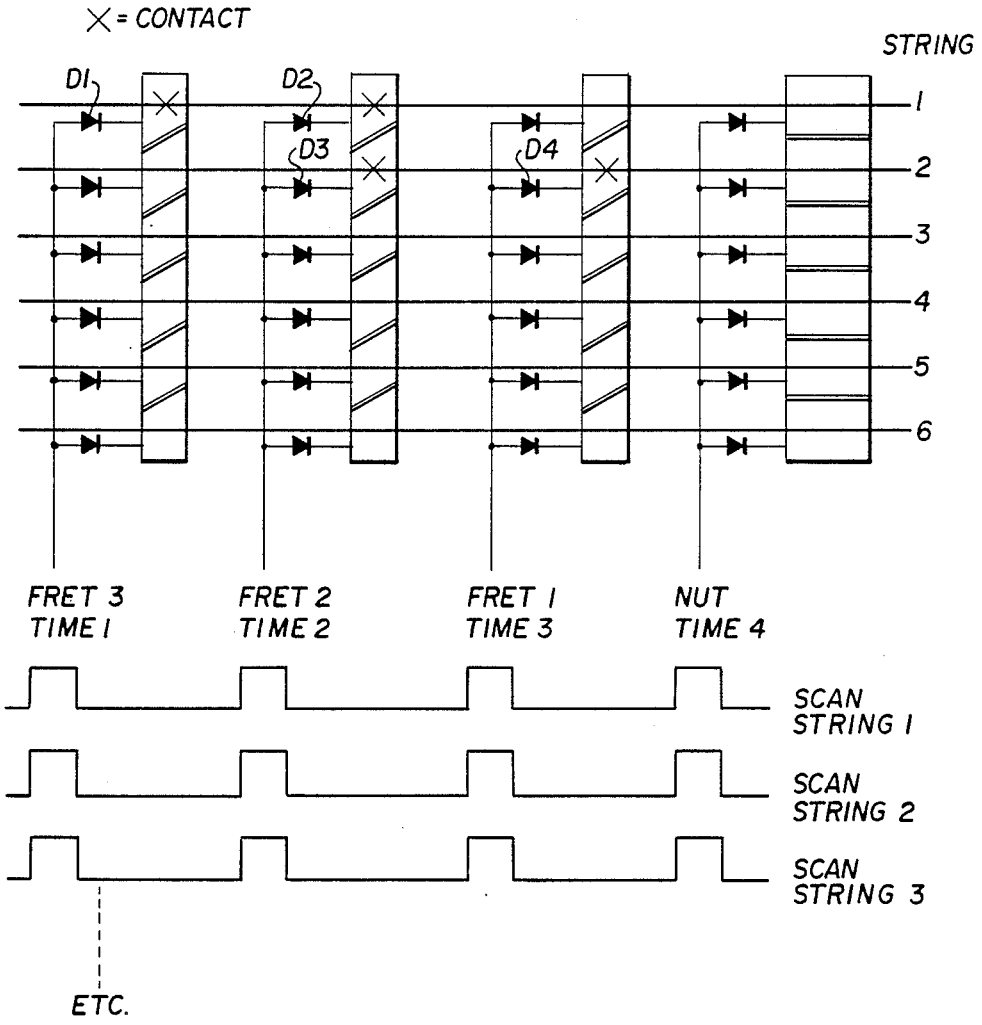
FIG. 1 PRIOR ART
FIG. 1 is a simplified schematic showing a prior art fingerboard for fret reading.

A prior art fingerboard having segmented frets, with associated strings, is shown in FIG. 1. This prior art electronic musical instrument uses a number of diodes, for example six (6), for each of the frets. For this prior art example, only four frets, with the lowest fret designated "nut", are shown. Each fret in turn is comprised of six diodes—for six strings per fret—so that, for this example, a total of twenty-four diodes are needed for the four frets of the musical instrument. For a conventional guitar with twenty-four frets, therefore, a total of one hundred and forty-four diodes are needed. Needless to say, the packaging of all these diodes into the fingerboard of a guitar becomes quite difficult and expensive.

To understand how the prior art frets are used, consider now diode D1 of fret 3 and presuppose that a pulse is generated in time 1 on fret 3. At this point, string 1 is scanned; as the pulse passes through diode D1 to string 1, since string 1 is the first to be scanned, the pulse is read as the intended pitch of string 1. Any additional pulses generated during the first scan cycle are ignored. As the pulse travels from string 1 to diode D2, it is blocked from affecting the fret 2 line. When string 2 is scanned, the first pulse is seen at time 2 through diode D3 and is read as the intended pitch for string 2. Further pulses of the scan cycle are ignored. The pulse from time 2 also goes through string 2 to diode D4 but is blocked thereby from affecting the fret 1 line. Although effective, this prior art method, as shown hereinabove and mentioned previously, is quite complicated and expensive to implement.

Figure 2:
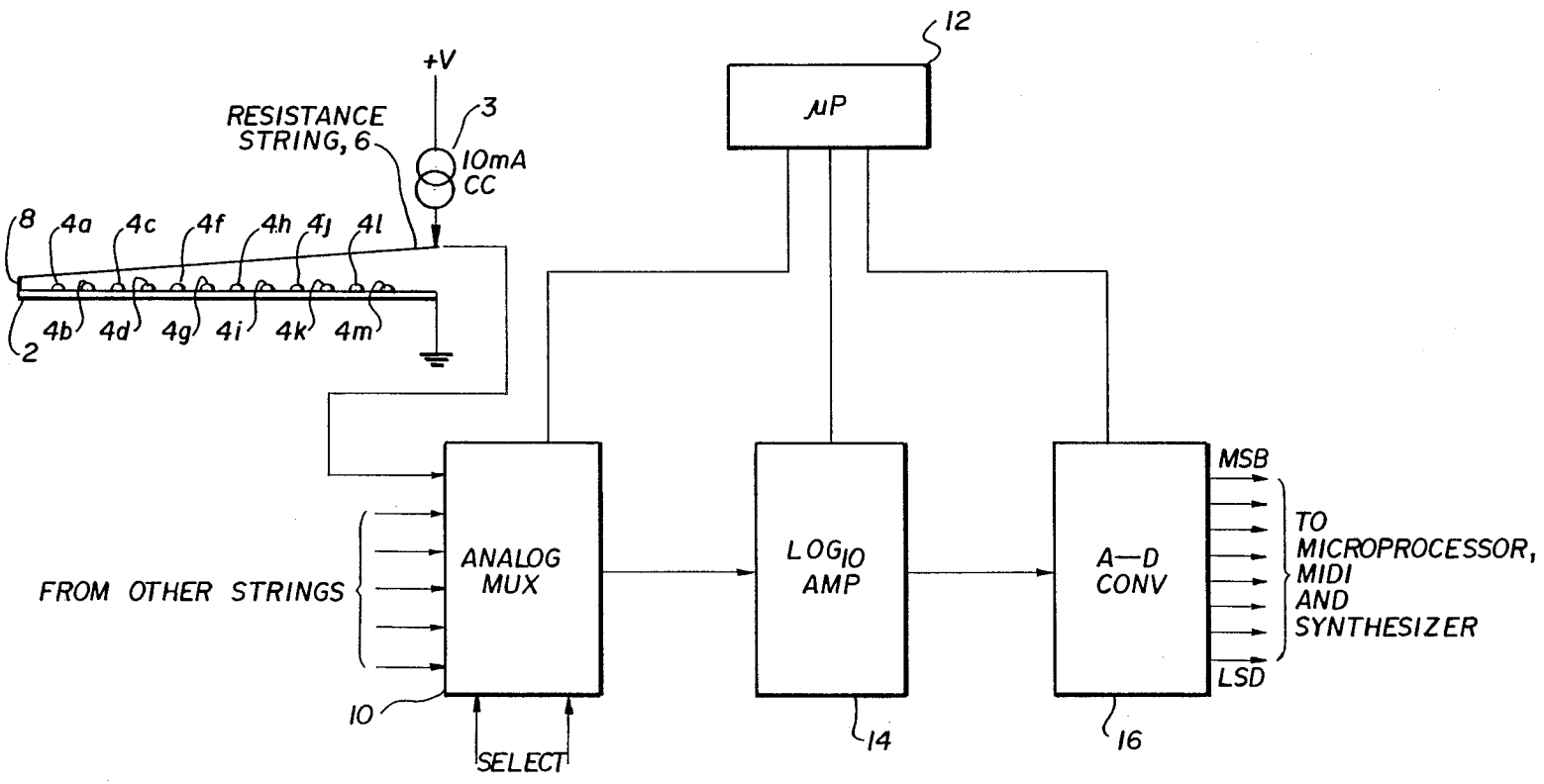
FIG. 2 is a semi-block diagram showing the essential components of an embodiment of the present invention musical instrument.

The essential components of an electronic stringed musical instrument according to an embodiment of the present invention are illustrated in FIG. 2. As shown, the instrument has an insulating fingerboard 2 having mounted thereon a plurality of conductive, grounded frets, designated 4*a* to 4*m*. A plurality of resistance wire strings 6, with only one shown in FIG. 2 for simplicity, attaches to the fingerboard at an end portion 8 thereof. For the purpose of this invention, the end portion may be equated with fret 4*a*, which is also known as the nut of fingerboard 2. The resistance wire is connected from end point 8 to a bridge (not shown) on the guitar and is energized by a constant current source 3 which, in an exemplary embodiment, may be 10 milli-amps. The outputs of the resistance strings are electrically connected to an analog multiplexer 10, which is conventional and may be, for example, part number 74HC4051 manufactured by the Signetics Company. The multiplexer is used to sample all six strings, one after another, and is under the control of a microprocessor 12, for example, a Zilog Super 8. The output of the analog multiplexer is connected to the input of a log 10 amplifier 14, hereinbelow to be referred to as log amplifier, the function of which will be further discussed. This log amplifier is conventional and is made by, for example, the Burr Brown Company under the trade name Log-100. The output of the log amplifier is fed to an analog to digital converter 16 such as an AD7820, which function is also to be discussed hereinbelow. Like multiplexer 10, amplifier 14 and A/D converter 16 are also selectively controlled by microprocessor 12. Signals which are outputted by the A/D converter are fed to a microprocessor (which may also be microprocessor 12), which in turn sends out conventional note number information compatible with the conventional MIDI channel. This information is to be sent to a synthesizer for generating the appropriate frequencies.

Figure 3:
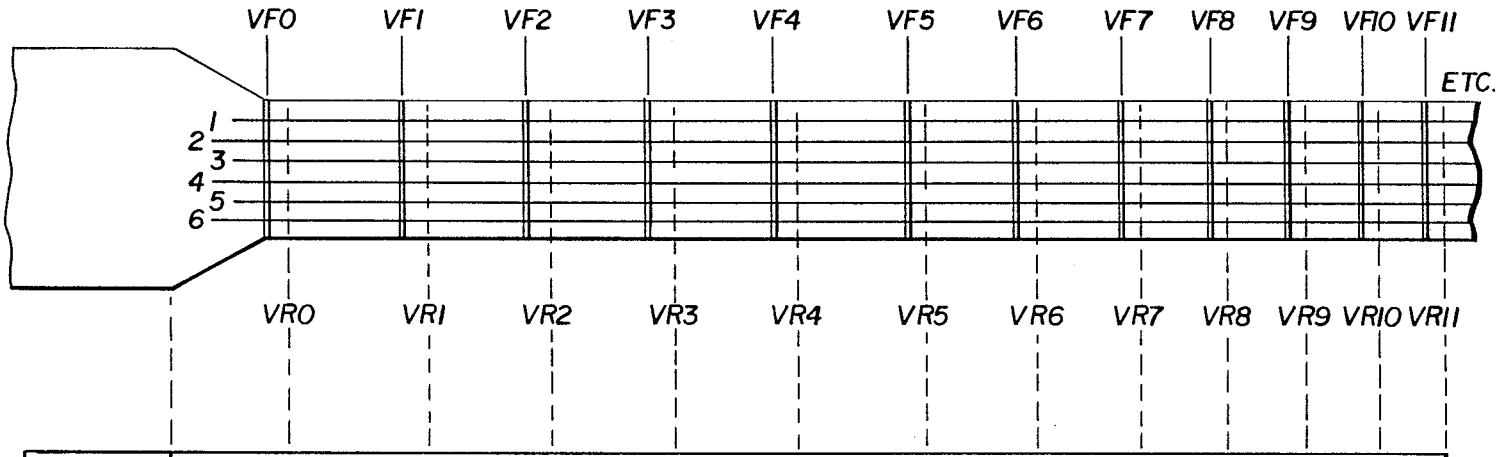
FIG. 3 is a plan view of a fingerboard of the present invention electronic musical instrument and the corresponding note numbers representative of the different fret readings.

Turning now to the fingerboard in FIGS. 2 and 3, it can be seen that there are mounted, or integrated, to fingerboard 2 twelve conductive frets, designated as 4*a* to 4*m* in FIG. 2 and also shown in FIG. 3, in spaced parallel relationship therealong. Superposed over the frets is a plurality of strings which number, conventionally, is six (6). As shown in the chart in the lower portion of FIG. 3, the strings are conventionally labeled E4 to E2.

As mentioned above, the resistance of a string when depressed may be affected by dirt, foreign matter or oxidation on the string which may have accumulated or which may be deposited by finger contact. These effects are known as "contact resistance", and unless accounted for will result in a false resistance value and hence the generation of sound having an incorrect frequency.

In accordance with this invention, to assure that only accurate frequencies are obtained, the voltages generated from each of the strings, with respect to the length of the string in relationship to the fingerboard, are quantized into a number of signals of different levels, corresponding in number to the number of frets. For example, as illustrated in FIG. 3 by the dotted lines VR0 to VR11 going from the fingerboard to the chart in the lower portion thereof, each of the frets is enclosed between two of the dotted lines: i.e., fret VF1 being situated between lines VR0 and VR1. These lines, incidentally, are arbitrarily chosen and referred to as voltage reference lines, otherwise known as voltage reference points or decision points, on the fingerboard and stored in the processor. As can be seen, each of the voltage reference points is offset, to a large extent, toward the fret on its left. This signifies that were a resistance wire string come into contact anywhere within the section designated, for example between VR0 and VR1, the voltage generated as a result of the completed electrical circuit would correspond to a predetermined voltage representative of fret VF1. The note numbers for the respective frets, in relation to the different strings, for standard tuning, are listed in the boxes in the chart at the lower portion of FIG. 3. It should be appreciated that these note numbers are conventional predetermined values assigned in accordance to the MIDI (Musical Instrument Digital Interface) protocol. For example, note number 60 in string B3 between voltage reference lines VR0 and VR1 is equalled to middle C of a piano keyboard, which in turn is equal to approximately 262 Hz. It should further be appreciated that these note numbers may be conventionally stored in a RAM (not shown) or directly in the microprocessor and may be recalled therefrom, when needed, as representative of the frequencies needed to drive the synthesizer.

Referring again to FIG. 2, it can be seen that since string 6 is a resistance wire and frets 4*a* to 4*m* are disposed along the length of fingerboard 2, when the string is displaced toward fingerboard 2 and then finally comes into contact with one of the frets (or the area near that fret), depending on the placement of the particular fret along fingerboard 2, the voltage generated when an electrical circuit is completed from the contact of string 6 to the particular fret would depend on the length of string 6, in reference to the point of contact and the bridge, which, although not shown, may be visualized as situated to the right of fret 4*m*. Thus, for this invention, were a string, out of the six strings, to come into contact with the area near one of the frets, for example, designation VF5, a voltage corresponding to the length of string 6 from the bridge to the fret corresponding to voltage VF5 will be outputted, irrespective of whether there is accumulation of dirt, foreign matter or oxide on the string (and thus greater resistance thereof), as the section partitioned by voltage reference points VR4 and VR5 has been quantized to equal to fret VF5.

The string voltages are fed to analog multiplexer 10, and are stored therein as other output voltages are scanned (by well known sensors controlled by the microprocessor) from the other strings. This signal is then outputted to log amplifier 14, which is used to linearize the voltage so that there is the same voltage difference from fret to fret on fingerboard 2. This makes it easier for the microprocessor to read the frets since all the latter has to do in determining how many frets there are and the frequency which is to be generated in response to a string contacting a particular fret is to divide the voltage by a predetermined value, which equals to the voltage difference between adjacent frets. The thus linearized signal from log amplifier 14 is then fed to A/D converter 16 so that the analog signal may be converted into a digital format so as to be compatible with the microprocessor, the MIDI convention and the synthesizer. As was mentioned previously and as well known in the art, the multiplexer, log amplifier and A/D converter are selectively controlled by microprocessor 12 so that their respective operations can proceed smoothly.

Refer now to FIG. 4 which illustrates how decision data is obtained for storage in the microprocessor. There is shown a chart illustrating the different frets and fret numbers for a conventional guitar having two octaves. As is shown, the first fret is referred to as the "nut" fret while the last fret is referred to as to "24th" fret. The voltages from the respective frets are as listed in the column titled fret volts which shows that there is a correspondence between the amount of fret voltage and the length of the resistance wire string. Since the fret voltages are an antilog function, to linearize the fret voltages, a log amplifier with a K factor of 3.98634 volts per decade is used. The thus linearized voltages are shown as voltages outputted from the log amplifier, with the output voltage increasing from the nut fret to the 24th fret due to the inverting nature of the log amplifier. There is an output offset from zero (0) so that there is room for any possible parameter drift without producing a negative output voltage, which is an undesirable condition. The data outputted from the A/D converter which, for the purpose of this invention, are converted to hexidecimal numbers, are shown in the two rightmost columns of FIG. 4. It should be noted that a +30% reference has been added to the output digital data for eliminating any ambiguities that may arise because of increase in the resistance of the wire string due to foreign matter such as dirt or oxides being accumulated on the string. Thus, the data in the rightmost column of FIG. 4 is stored as decision voltage data in the microprocessor. As strings are depressed to fret, during playing, the voltages generated are inverted and linearized and compared in the processor with the decision voltages for deciding which of the fret voltages VF0, VF1, etc. is to be used to control frequency generation as previously explained.

Inasmuch as the present invention is subject to many variations, modifications and changes in detail, it is intended that all matter described throughout this specification and shown in the accompanying drawings be interpreted as illustrative and not in a limiting sense. Accordingly, it is intended that the invention be limited only by the spirit and scope of the appended claims.

I claim:

1. In an electronic musical instrument of the stringed type, wherein the instrument includes a body and a fingerboard having conducting portions each connected to ground, the fingerboard being attached to a body and wherein the electronic instrument further comprises:

a plurality of spaced parallel resistance wire strings superposed over the fingerboard for completing respective electrical circuits when they contact said conducting portions;

means for electrically energizing said electrical circuits;

means for securing the strings in relative spaced relationship with respect to the fingerboard;

circuit means for ensuring that when at least one of the resistance strings is displaced toward the fingerboard and comes into contact with a conducting portion thereon for completing one of said electrical circuits, an analog voltage which has a magnitude which is dependent on the length of the string with respect to the contacted area and a reference point is generated, the length of the string representative of an effective electrical resistance; and means for quantizing the generated analog voltage to a representative level which is determined by the magnitude of the voltage generated, the possible magnitudes which may be generated being divided into a plurality of first voltage magnitude ranges for each string and said means for quantizing being operative to quantize all voltage magnitudes within each range to the same level associated with such range, for minimizing undesired effects of resistance variations of the string due to contact resistance effect.

2. The electronic instrument of claim 1 wherein the conducting portions of the fingerboard comprise a plurality of frets.

3. The electronic instrument of claim 2 wherein the frets have voltage magnitudes associated with them, the fret magnitude for each fret being a voltage generated by said circuit means which is determined by the voltage magnitude which occurs in the absence of contact resistance when each resistance string is depressed to contact with the fret, and wherein said first voltage magnitude ranges and said fret magnitudes are not identical.

4. The electronic instrument of claim 3 wherein the upper limits of said first magnitude ranges are higher than said fret magnitudes.

5. The electronic instrument of claim 4 wherein the upper limits of said respective first magnitude ranges are about 30% higher than said fret magnitudes.

6. The electronic instrument according to claims 1 or 3, further comprising:

multiplexing means electrically connected to the strings for receiving analog voltages generated thereby and relating these voltages as different signals from the strings.

7. The electronic instrument according to claim 6, further comprising:

means for linearizing the signals from the multiplexing means so that the amount of voltage for a length of a string between two adjacent frets is the same throughout the string.

8. The electronic instrument of claim 7 further comprising:

means for inverting the voltage signals produced when said strings contact said frets.

9. The electronic instrument according to claim 8, further comprising:

means for converting the linearized, inverted signals from analog to digital.

10. The electronic instrument according to claim 9, further comprising:

processing means for receiving the converted signals and correlating the signals to particular ones of a plurality of predetermined frequencies for generating corresponding musical notes.

11. The electronic instrument according to claim 1, wherein the electrically energizing means comprises a constant current source.

12. The electronic instrument according to claim 1, wherein the securing means includes a bridge and wherein the strings are disposed between a nut end of the instrument and the bridge.

* * * * *